United States Patent [19]

Ortmanns

[11] 4,164,108

[45] Aug. 14, 1979

[54] FIRE-PROOF WINDOW

[75] Inventor: Günther Ortmanns, Aachen, Fed. Rep. of Germany

[73] Assignee: Saint-Gobain Industries, Neuilly-sur-Seine, France

[21] Appl. No.: 908,018

[22] Filed: May 22, 1978

[30] Foreign Application Priority Data

Jul. 15, 1977 [DE] Fed. Rep. of Germany ..... 2731979

[51] Int. Cl.[2] ..... E04C 2/02; E04B 1/94

[52] U.S. Cl. ..... 52/232; 52/573; 52/308; 52/764; 52/476

[58] Field of Search ..... 52/1, 232, 573, 476, 52/766, 765, 764; 428/428, 920, 921

[56] References Cited

U.S. PATENT DOCUMENTS

| | | | |
|---|---|---|---|
| 1,159,071 | 11/1915 | Murnane | 52/764 |
| 3,837,126 | 9/1974 | Voiturier | 52/232 |

FOREIGN PATENT DOCUMENTS

| | | | |
|---|---|---|---|
| 872111 | 3/1953 | Fed. Rep. of Germany | 52/764 |
| 851548 | 10/1953 | Fed. Rep. of Germany | 52/764 |
| 617644 | 2/1961 | Italy | 52/769 |
| 442692 | 1/1968 | Switzerland | 52/764 |
| 945894 | 1/1964 | United Kingdom | 52/766 |

*Primary Examiner*—James L. Ridgill, Jr.
*Attorney, Agent, or Firm*—Pennie & Edmonds

[57] ABSTRACT

This invention relates to a fire-proof window consisting of at least one glass sheet mounted in a frame and which permits generally uniform heating of the glass sheet when exposed to the effect of heat in a fire thus preventing breakage due to the buildup of stresses. Uniform heating is produced by the inclusion of a listel along the edge of the glass which is moved away from the glass by means of a member disposed between the listel and glass. This member expands in volume under the effect of heat to push the listel away from the glass sheet.

9 Claims, 3 Drawing Figures

FIRE-PROOF WINDOW

BACKGROUND OF THE INVENTION

In a fire, the glass sheet or pane of a conventional window unit is subjected to uneven heating because its edge is enclosed in the window frame and therefore not heated at the same rate as the center region of the sheet. As a result, stresses resulting from expansion occur in the edge region of the sheet and lead to rupture of the window.

Windows constructed to withstand the effects of fire without premature breakage are generally known. Examples of such windows are described in German Auslegungsschrifts Nos. 2,328,737 and 2,344,459 and German application No. 2,527,134. In these prior art constructions, provisions have been made for decreasing the temperature gradient between the center of the glass sheet and its edge region by leaving the edge of the glass sheet exposed, or at least partially exposed, on the side of the window unit which may be subjected to the effects of fire. Other constructions involve the use of protective glass placed on the fireside of the silicate glass or the use of glass which itself is specially constructed to resist the effects of fire.

In copending application "Fire-Proof Window", filed Dec. 5, 1977, Ser. No. 857,417, and assigned to the assignee of the present application, still another fire-proof window is disclosed. There, the edges of the glass sheet are covered with a decorative listel. The listel is adhesively secured, either directly or indirectly to the glass sheet by an adhesive or solder that loses its effectiveness upon being subjected to the heat of a fire. Thus, in a fire the listel falls away to expose the edges of the glass sheet to heating at substantially the same rate as the center of the sheet to prevent the creation of thermal stresses.

SUMMARY OF THE PRESENT INVENTION

In accordance with the teachings of the present invention, a fire-proof window unit is constructed with a normal silicate glass sheet or sheets and the edges of the sheets are covered by perforated metal cushion frames for fastening the silicate glass sheet on the side exposed to the fire. Listels are then fastened to the outer surface of the cushion frames.

The elimination of the listels is induced or at least accelerated and made to be more reliable by inserting appropriate ejection members between the listels and the window frame or glass sheet. In particular, the listels are fastened onto the cushion frame with the interposition of a material which increases in volume under the effect of heat in order to induce ejection. Such materials can be, for example, those which decompose by foaming at a temperature which is slightly below 120° C. Alkaline silicates containing 10 to 40% water are particularly appropriate for this use.

These materials are presently used to provide intermediate capacifying layers through foaming in fire-proof window panes such as disclosed in German Pat. No. 1,900,054. With addition of 10 to 40% by weight of inorganic fibers, they are also used as layers of coating in grooves of assembly sections and slides for fire-proof partitions, their purpose being to plug up cracks in case of fire through expansion of the mass. See German Pat. No. 1,852,959.

Products which foam under the effect of heat may be constructed in the form of compact strips which may be pasted onto the back face of the listels. In order to avoid their adherence onto the metal parts of the window frame during foaming thus preventing detachment of the listel from the frame, the foaming strip can be isolated from the frame structure by a layer of non-adherent material, as for example, an aluminum sheet.

With the above construction, the presence of the listels in the initial phase of the fire is not enough to create a sufficient temperature gradient between the center and the edges of the glass sheet which would give rise to stresses that might lead to the premature rupturing of the sheet. When the edge of the glass sheet is subsequently uncovered upon the removal of the listel, the temperature across the glass sheet quickly becomes equalized and the initial stresses disappear.

DETAILED DESCRIPTION OF THE PREFERRED EMBODIMENTS

Figure 1:
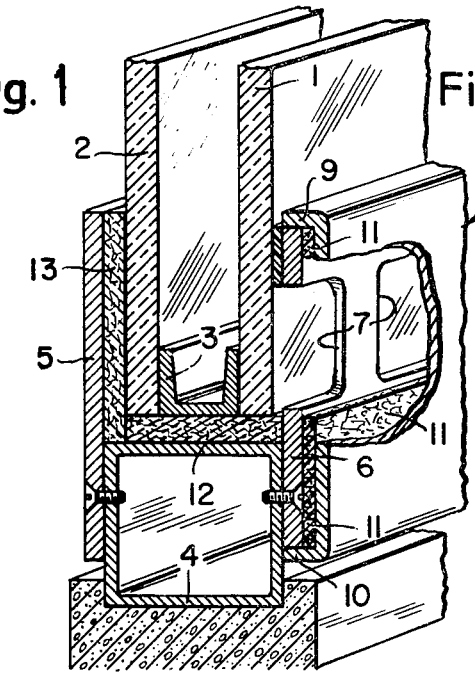
FIG. 1 is a partial perspective view showing an embodiment of the present invention in which the listel is pinched onto the cushion frame and an intermediate foaming strip is positioned between the frame and listel.
Figure 2:
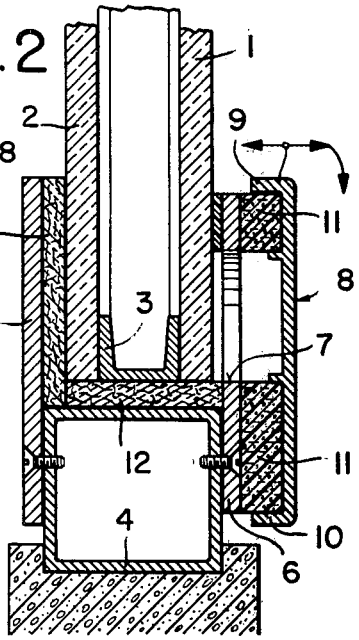
FIG. 2 is a cross-sectional view of the window of FIG. 1 as deformed under the effect of fire.

The embodiment shown in FIGS. 1 and 2 is an asymmetrically designed window that resists the action of flames and heat on one side while breaking relatively rapidly when the flames and heat come from the other side. Such an asymmetrical construction is especially practical in facades, particularly in the facades of high-rise buildings, where it is necessary to resist the attack of flames on the outside of the building while freeing the window aperture when the flames strike from inside.

The window shown in FIG. 1 comprises two hardened silicate glass window panes 1 and 2 separated by an insert 3 and mounted into a frame 4 made of a rectangular tube fastened into the splay of a wall. The panes are maintained by a flat iron cushion frame 5 on the internal face of the window and by a cushion frame 6, perforated with openings 7, on the external face. The perforations permit heating of the edge or border of the pane 1 when the cushion frame is exposed thus preventing the formation of dangerous temperature gradients in the pane.

The perforated cushion frame 6 is normally covered with a listel 8. The latter is U-shaped and with the flanges 9 and 10 covering the cushion frame 6 from the top to bottom and pinching it at its upper and lower edges. The listel is thus secured by a friction-fit.

Strips 11 are arranged on the internal face of listel 8. Strips 11 are constructed of a hydrated alkaline silicate or other metallic hydrate acting in a similar manner. Between the edges of the double pane 1, 2 and frame 4 is placed an insulating strip 12 consisting, for example, of asbestos. Similarly, an insulating strip 13 runs between glass sheet 2 and cushion frame 5. The latter can also advantageously consist of a material which foams under the effect of heat and gives up its place when the window is deformed under the effect of heat to exert stresses.

FIG. 2 shows schematically the behavior of the window when exposed to fire. Under the effect of heat, the foaming material comprising the strip 11 swells and pushes back listel 8 so that the latter separates from perforated cushion frame 6 and falls, thus exposing openings 7.

Figure 3:
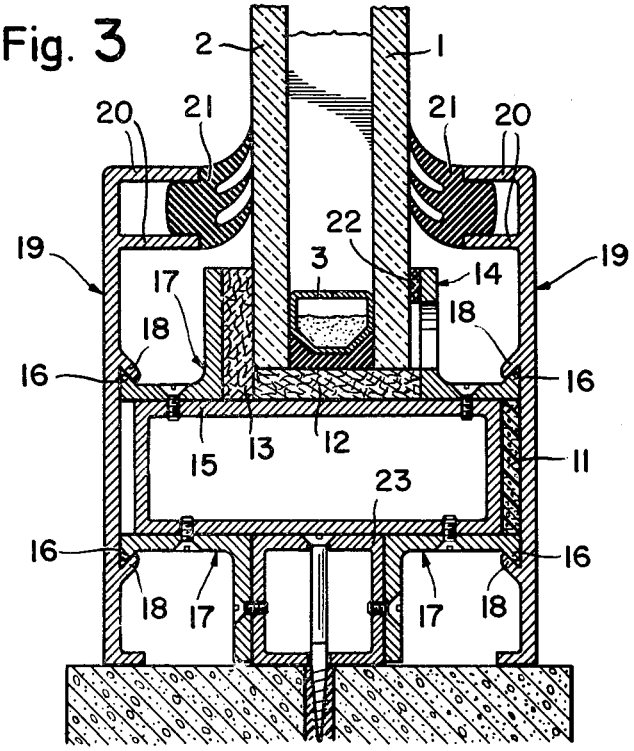
FIG. 3 is a cross-sectional view showing a varying embodiment of the construction of FIG. 1.

FIG. 3 shows a varying embodiment in which the perforated cushion frame is an angle bar 14 screwed onto the rectangular tube 15 of the frame through a flange which extends beyond it and which ends with a ribbed edge 16. Another angle bar 17 one flange of which also has a ribbed edge 16 is screwed below rectangular tube 15 and both ribbed edges 16 cooperate with additional ribs 18 of listels 19 which is thus held in place by a snap-fit. The foaming strip 11 is interposed between the rectangular tube 15 and the listel 19. The listel itself extends upwardly to a double flange 20 which creates a U-shaped groove into which an elastic air seal 21 is inserted. An insulating asbestos strip 22 is interposed between the perforated cushion frame 14 and glass sheet 1.

Tube 15 is mounted on a frame 23, in turn, permanently fixed into the splay of the wall. The internal face of the frame is similar to its external face, the only difference being that the cushion frame which immobilizes the glass sheet is a known non-perforated cushion frame 17. An insulating strip 13, the function of which has already been described in relation to FIG. 1, is interposed between the vertical flange of the frame 17 and the glass sheet 2.

I claim:

1. In a fire-resistant window having at least one glass sheet mounted in a main frame disposed about the peripheral edge of the glass sheet with the edge region of the sheet on the side thereof to be exposed to the heating effect of fire being at least partially exposed and free of frame structure, the improvement comprising:

(a) cushion frame means disposed over said edge region and connected to said main frame and having openings therethrough exposing the edge region of the sheet;

(b) listel means attached over said cushion frame means and covering said openings; and (c) ejection means disposed between said listel means and cushion frame means, said ejection means being responsive to the heat of fire to detach and remove said listel means from said cushion frame means.

2. A window according to claim 1 wherein:

(a) said listel means includes bent flanges for attaching the listel means to the cushion frame means through a friction-fit connection.

3. A window according to claim 1 wherein:

(a) first projections extend from said cushion frame means; and (b) second projections extend from said listel means for cooperating with the first projections for attaching the listel means to said cushion frame means through a snap-fit.

4. A window according to claim 1 wherein:

(a) the ejection means consists of a material the volume of which increases under the effect of heat.

5. A window according to claim 4 wherein:

(a) the ejection means consists of a hydrated alkaline silicate which is converted into a foaming mass under the effect of heat.

6. A window according to claim 5 wherein:

(a) the ejection means is in the form of a strip of compact material.

7. A window according to claim 6 wherein:

(a) the ejection means in the form of a strip of material is glued on one side thereof to the back of the listel means.

8. A window according to claim 7 wherein:

(a) the ejection means in the form of a strip of material is coated on the other side thereof with a layer of material free of the cushion frame.

9. A window according to claim 8 wherein:

(a) the layer of material is a metallic sheet of aluminum.

* * * * *